US005826736A

United States Patent [19]

Weber

[11] Patent Number: 5,826,736

[45] Date of Patent: Oct. 27, 1998

[54] COUPLER ARM ASSEMBLY WITH DISTINCT UNCOUPLING DEVICES

[75] Inventor: Michael G. Weber, Rochester Hills, Mich.

[73] Assignee: Lionel LLC, Chesterfield, Mich.

[21] Appl. No.: 832,584

[22] Filed: Apr. 2, 1997

[51] Int. Cl.[6] ..... B61G 5/00

[52] U.S. Cl. ..... 213/75 A; 213/75 TC

[58] Field of Search ..... 213/159, 211, 213/212, 75 A, 75 TC

[56] References Cited

U.S. PATENT DOCUMENTS

| | | | |
|---|---|---|---|
| 2,213,286 | 9/1940 | Pettit | 213/75 TC |
| 2,297,143 | 9/1942 | Giaimo | 213/75 TC |
| 3,659,725 | 5/1972 | Passalacqua | 213/75 TC |
| 5,423,439 | 6/1995 | Richter | 213/75 TC |

FOREIGN PATENT DOCUMENTS

| | | | |
|---|---|---|---|
| 2806739 | 4/1979 | Germany | 213/75 TC |

*Primary Examiner*—S. Joseph Morano

*Attorney, Agent, or Firm*—Rader. Fishman & Graur, PLLC

[57] ABSTRACT

A coupler arm assembly is disclosed which includes a coupler frame with a coupler head and a channel. A hollow housing is defined between the coupler head and the channel. A knuckle is pivotally connected to the coupler head and movable between a coupled position and an uncoupled position. A core pin is received in the hollow housing of the frame. A first end of the pin selectively engages a detent of the knuckle and a second end of the pin extends away from the hollow housing parallel to the channel. The assembly includes two distinct uncoupling devices. The first device includes a solenoid disposed about an outer periphery of the coupler frame. The solenoid applies a magnetic force upon activation to move the pin from engagement with the knuckle. The second device includes a lever arm pivotally connected to the coupler frame adjacent a first end, a plunger adjacent a second end, and an uncoupler armature extending downwardly from the lever arm. The plunger passes through the channel and engages a bore formed in a block connected to the core pin. The armature is selectively moved from a biased upward position to a downward position where the plunger works in combination with the block such that the pin is no longer in contact with the knuckle detent.

20 Claims, 1 Drawing Sheet

COUPLER ARM ASSEMBLY WITH DISTINCT UNCOUPLING DEVICES

FIELD OF THE INVENTION

The present invention relates to a coupler arm assembly for a model train truck, and more particularly to the use of distinct uncoupling devices to uncouple two adjacent trucks.

BACKGROUND OF THE INVENTION

In the past, model train trucks were uncoupled from adjacent trucks by hand. As a result, only one type of truck was required. Over time, however, various ways of remotely uncoupling model train trucks have been devised. In turn, trucks have become much more customized, working only with certain types of model train systems. As a result, manufacturers have been required to reduce the variety of trucks offered for any one type of model train system, or supporting one system to the exclusion of others.

Purchasers have been required to select one model train decoupling system even if there are certain advantages to one system over another under different circumstances. Once a system has been selected, increased purchaser care has been required to make sure that a truck which is purchased actually works with that system. Further, if a model train decoupling system is later changed, entirely different trucks have typically been required, increasing the cost and inconvenience of switching.

Some sophisticated model train enthusiasts may have more than one decoupling system which their train layout supports. However, the trucks themselves are limited to only one of the systems. Therefore, the enthusiast must remember which decoupling system works with which trucks. Such a requirement detracts from the realism of the model train experience.

SUMMARY OF THE INVENTION

The present invention relates to a coupler arm assembly for a model train truck using two distinct uncoupling devices to uncouple adjacent trucks The assembly includes a coupler frame with a coupler head at one end and a hole used to engage the assembly to a truck at a second end. A hollow housing is defined adjacent the coupler head and a trough with a channel extending along its base is defined adjacent the hole. A knuckle is pivotally connected to the coupler head by means of a pivot pin and is movable between a coupled position and an uncoupled position. A core pin extends along the longitudinal axis of the frame within a bore of the hollow housing and is selectively disengaged from the knuckle by means of two different uncoupling devices.

The first uncoupling device includes a solenoid disposed about an outer periphery of the coupler frame. Upon the application of electricity to the solenoid, it generates a magnetic field which moves the core pin from engagement with a detent formed in the knuckle. Once the pin is no longer engaged with the knuckle detent, the knuckle is free to move to an uncoupled position to help eject a member from an adjacent truck received in the coupler head.

The second uncoupling device includes a lever arm pivotally connected to the coupler head adjacent a first end and a plunger adjacent a second end of the lever arm. An uncoupler armature extends downwardly from the lever arm between the first and second ends. The uncoupler armature includes an iron-bearing outer surface adapted to react to the application of magnetic force to pivot the lever arm pivotally downwardly from its default biased position. The plunger passes through the channel of the trough to be received in a bore formed in a movable block slidable within the trough. The moving block is connected to the end of the core pin, opposite the end which engages the knuckle. In a preferred embodiment, both the bore of the moving block and the plunger are angled.

When the coupler arm assembly is positioned over a portion of track with an electromagnet, the lever arm pivots downwardly toward the electromagnet upon the application of electricity to the electromagnet. The angled nature of the plunger and its corresponding bore in the block result in the movement of the plunger within the channel and a corresponding movement of the block within the trough toward the hole at the end of the frame. The movement of the block results in the disengagement of the pin from the knuckle detent.

Preferably, the core pin is biased to be engaged with the knuckle detent. One means for biasing requires the use of a compression spring between two different sections of the core pin. A second means for biasing relies on the lever arm of the second uncoupling arm being biased upwardly as discussed above.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF A PREFERRED EMBODIMENT

Figure 1:
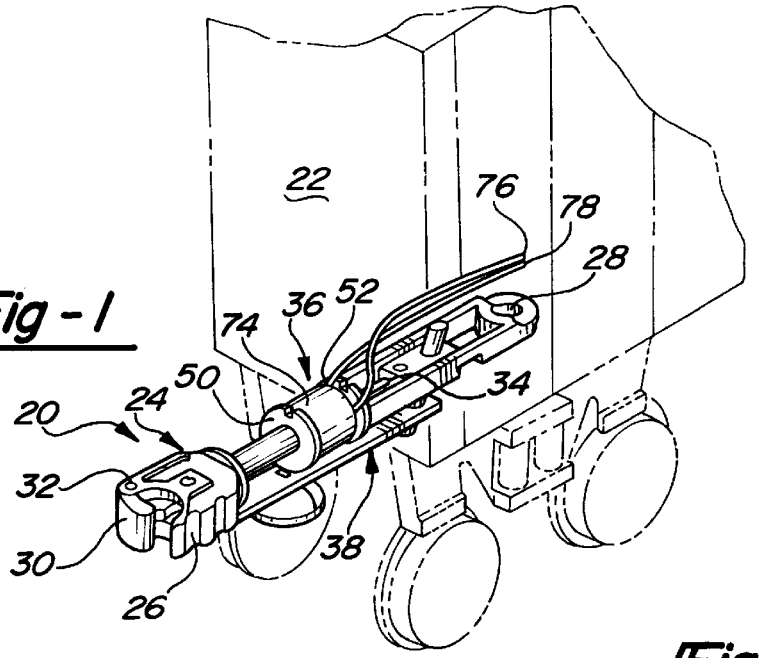
FIG. 1 is a perspective view of a model train truck with the inventive coupler arm assembly.

A coupler assembly 20 for use with a model train truck 22 is illustrated in FIG. 1. Assembly 20 includes a coupler frame 24 extending along a longitudinal axis with a coupler head 26 at one end and a hole 28 used to engage assembly 20 to truck 22 at a second end. A knuckle 30 is pivotally connected to coupler head 26 by means of a pivot pin 32, and is movable between a coupled position and an uncoupled position. A core pin 34 extends along the longitudinal axis of frame 34 and is selectively disengaged from knuckle 30 using one of two distinct uncoupling devices 36 and 38.

Figure 2:
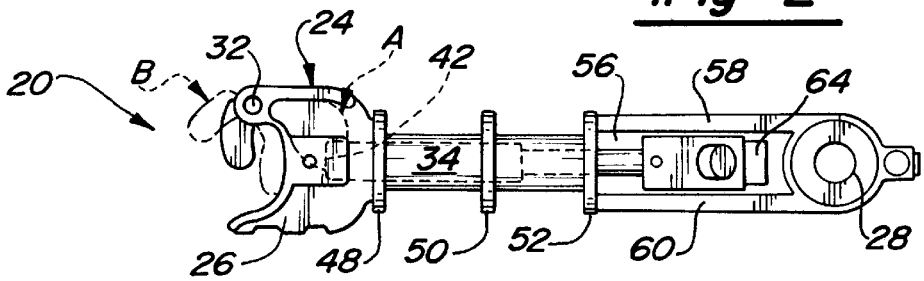
FIG. 2 is a planar view of the coupler arm assembly showing the movement of the knuckle between the coupled and uncoupled positions.
Figure 3:
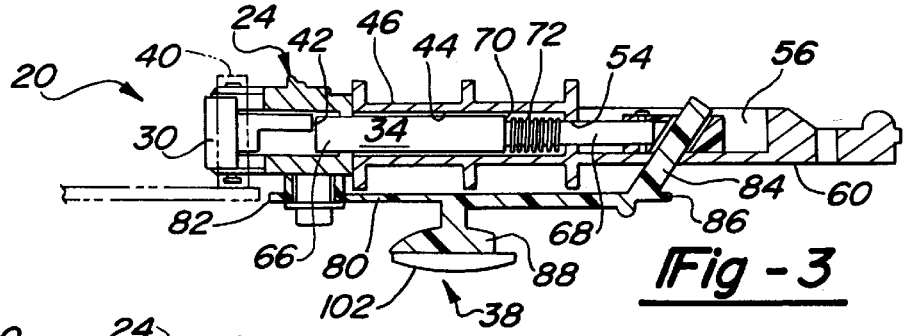
FIG. 3 is a partial cross-sectional view of the coupler arm assembly in the coupled position.
Figure 4:
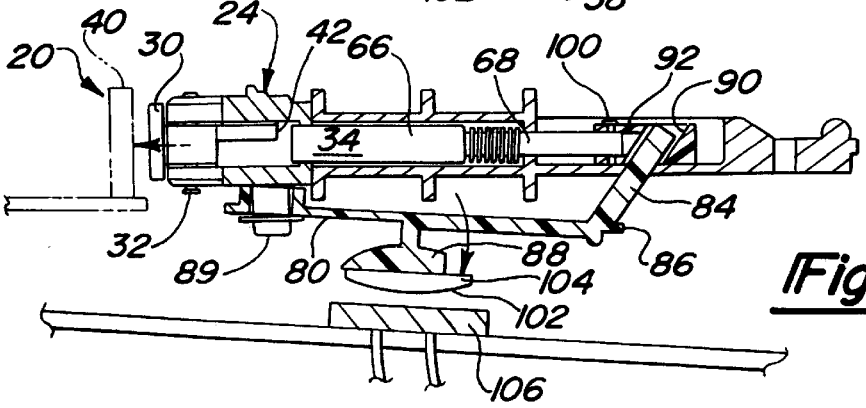
FIG. 4 is a partial cross-sectional view of the coupler arm assembly in the uncoupled position.

Coupler assembly 20 is illustrated in greater detail in FIGS. 2 through 4. Knuckle 30 is shown in a coupled position A and an uncoupled position B in FIG. 2. As illustrated in FIGS. 3 and 4, knuckle 30 and coupler head 26 work in combination to selectively receive a cylindrically-shaped male member 40 of an adjacent truck. Knuckle 30 is coupled to member 40 in FIG. 3 and uncoupled from it in FIG. 4.

A spring (not shown) associated with pin 32 biases knuckle 30 towards the uncoupled position B. A rearward portion of knuckle 30 includes a detent 42 that is selectively engaged by core pin 34. When member 40 engages knuckle 30, the biasing action of the spring is overcome to move the knuckle into a coupled position where detent 42 engages core pin 34 as shown in FIGS. 2 and 3. Once pin 34 and detent 42 are engaged, knuckle 30 stays in the coupled position shown in FIG. 3 until pin 34 is removed from detent 42. Once pin 34 is removed as shown in FIG. 4, the biasing action of the spring moves knuckle 30 to the uncoupled position to help eject member 40 from coupler assembly 20 as shown by the arrow.

Core pin 34 is slidably received in a bore 44 of a hollow housing 46 which is formed in frame 24 adjacent coupler head 26. Housing 46 is preferably annular, and includes a front wall 48, an intermediate wall 50, and an end wall 52. Walls 48, 50 and 52 have a greater diameter than the rest of housing 46. A portion of end wall 52 extends into bore 42 to create a core pin aperture 54. A trough 56 is defined between end wall 52 and hole 28 and includes side walls 58 and 60 and a base 62. A channel 64 extends along a portion of base 62 preferably equidistant from side walls 58 and 60.

Core pin 34 includes a front section 66 having a first diameter and a rear section 68 having a second diameter smaller than the first diameter. A ledge 70 is formed in the transition zone between sections 66 and 68. Front section 66 selectively engages detent 42 while rear section 68 passes through aperture 54 of end wall 52 into trough 56.

A compression spring 72 is preferably disposed between end wall 52 and ledge 70 of pin 34. Spring 72 biases pin 34 into engagement with knuckle 30. When member 40 engages knuckle 30 and moves it to a coupled position as discussed above, the biasing action of spring 68 assures that pin 34 correctly engages detent 42 of the knuckle to lock member 40 into position within coupler head 26.

As noted above, to uncouple member 40 from coupler assembly 20, it is necessary to slidably remove core pin 34 from detent 42 of knuckle 30. When pin 34 is removed, a greater portion of pin section 68 extends into trough 56 as best shown in FIG. 4. Once pin 34 is removed, the biasing action of the spring associated with pin 32 helps eject member 40.

One possible means for uncoupling coupler arm assembly 36 involves the use of device 36 preferably located between intermediate wall 50 and end wall 52 about the outer periphery of hollow housing 44. As best illustrated in FIG. 1, device 36 relies on walls 50 and 52 to provide additional support. Device 36 comprises a solenoid 74 which is preferably activated by means of a radio signal. Electrical power is provided to a radio receiver (not shown) and solenoid 74 by means of the track on which car 22 rides. When a signal is received, the radio receiver activates solenoid 74 using electrical wires 76 and 78 to create a magnetic flux field which overcomes the biasing action of spring 72 and device 38, as discussed below, to slidably move pin 34 from engagement with detent 42 of knuckle 30. For proper operation of device 36, frame 24 is made from a material such as plastic or aluminum which will not interfere with the magnetic flux field. In contrast, pin 34 is formed from iron to react to the flux field generated by solenoid 74. The operation of solenoid 74 is promoted by positioning ledge 70 of pin 34 between intermediate wall 50 and end wall 52 to provide additional iron mass within the flux field created by the solenoid when activated.

Under certain circumstances it may be impossible or undesirable to uncouple member 40 by means of solenoid 74. For example, a model train operator may lack a radio transmitter able to communicate with a radio receiver located in a truck 22. Alternatively, an operator may wish to precisely control the track location where uncoupling takes place. As a result, coupler arm assembly 20 also incorporates uncoupling device 38. Device 38 includes a lever arm 80 pivotally connected to coupler frame 24 adjacent a first end 82, a plunger 84 adjacent a second end 86, and an uncoupler armature 88 located between ends 82 and 86. Device 38 is biased upwardly as shown in FIG. 3. In the default position, device 38 works in combination with spring 72 to bias core pin 34 into engagement with knuckle 30. Lever arm 80 is attached to coupler head 26 by means of a threaded screw and washer combination 89. Therefore, a pivoting action about screw 89, as shown in FIG. 4, is required to move device 38 downwardly. In a preferred embodiment, lever arm 80, plunger 84, and a portion of uncoupler armature 88 are molded from an integral piece of plastic.

Plunger 84 extends outwardly away from lever arm 80 at a given angle with respect to the longitudinal axis of frame 24. The given angle is greater than 90 degrees and less than 180 degrees, preferably between 120 and 150 degrees, and most preferably 130 degrees. Plunger 84 extends through channel 64 and engages a bore 90 within a moving block 92. Plunger 84 fits somewhat loosely within bore 90 to prevent undesirable binding. To also eliminate binding, bore 90 is preferably inclined at approximately the same angle as plunger 84 with respect to the longitudinal axis of frame 24. Moving block 92 slides within trough 56. It includes a base 94 which is in facial contact with base 58 of trough 56, and side walls 96 and 98 which are slightly spaced from side walls 58 and 60 of the trough, respectively. Moving block 92 is connected to the end of rear section 68 of core pin 34 by means of a pin 100.

Uncoupler armature 88 is approximately equidistant between ends 82 and 86, extends downwardly, and includes at least an iron-bearing outer surface 102. A separate iron plate 104 is bonded to the non-metal portion of armature 88.

When coupler arm assembly 20 is positioned over a portion of track with a magnet such as electromagnet 106, it is possible to pivot lever arm downwardly as shown in FIG. 4 against the biasing of spring 72 and device 38. Typically, the movement of lever arm 80 depends upon the application of electricity to electromagnet 106, resulting in the attraction of iron-bearing surface 102 toward the magnet. The angled nature of plunger 94 and bore 90 results in the movement of the plunger along channel 64 and a corresponding movement of block 92 within trough 56 toward hole 28. The movement of block 92 results in disengagement of pin 34 from detent 42 of knuckle 30 and the decoupling of member 40 as discussed above.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed:

1. A coupler arm assembly comprising:

a coupler frame extending along a longitudinal axis with a coupler head and a channel, a hollow housing defined between said coupler head and said channel;

a knuckle pivotally connected to said coupler head and movable between a coupled position and an uncoupled position;

a core pin received in said hollow housing, a first end of said core pin selectively engaging said knuckle and a second end of said core pin extending away from said hollow housing and parallel to said channel; and two distinct uncoupling devices for moving said knuckle from said engaged position to said uncoupling position.

2. A coupler arm assembly as recited in claim 1, wherein each of said devices selectively moves said core pin from engagement with said knuckle.

3. A coupler arm assembly as recited in claim 2, wherein said core pin includes a rear section having a first diameter, and a front section having a second diameter greater than said first diameter.

4. A coupler arm assembly as recited in claim 3, wherein said hollow housing includes an end wall, said rear section of said core pin passing through an aperture formed in said end wall, and a compression spring disposed about an outer periphery of said rear section of said core pin, a first end of said compression spring engaging said front section and a second end engaging said end wall of said hollow housing, said compression spring biasing said core pin into engagement with said knuckle.

5. A coupler arm assembly as recited in claim 2, wherein at least one of said uncoupling devices comprises a solenoid disposed about an outer periphery of said coupler frame, said solenoid applying a magnetic force upon activation to move said core pin from engagement with said knuckle.

6. A coupler arm assembly as recited in claim 5, wherein said solenoid is disposed about an outer periphery of said hollow housing.

7. A coupler arm assembly as recited in claim 2, wherein at least one of said uncoupling devices comprises a lever arm pivotally connected to said coupler frame adjacent a first end, a plunger adjacent a second end, and an uncoupler armature extending downwardly from said lever arm, wherein said plunger passes through said channel.

8. A coupler arm assembly as recited in claim 7, wherein said uncoupler armature includes an iron-bearing outer surface adapted to react to the application of magnetic force to pivot said lever arm pivotally downwardly.

9. A coupler arm assembly as recited in claim 8, wherein said lever arm, said plunger, and a portion of said uncoupling armature are all formed from a non-iron bearing material.

10. A coupler arm assembly as recited in claim 7, said coupler frame including a trough, said channel formed in a base of said trough, a moving block slidable within said trough, a first end of said moving block connected to said second end of said core pin and a bore extending through said moving block adjacent a second end, said plunger received in said bore.

11. A coupler arm assembly as recited in claim 10, wherein said plunger is angled outwardly away from said lever arm at a given angle with respect to said longitudinal axis, said bore being angled at substantially said given angle.

12. A coupler arm assembly comprising:

a coupler frame extending along a longitudinal axis with a coupler head and a channel, a hollow housing defined between said coupler head and said channel;

a knuckle pivotally connected to said coupler head and movable between a coupled position and an uncoupled position;

a core pin received in said hollow housing, a first end of said core pin selectively engaging said knuckle and a second end of said core pin extending away from said hollow housing and parallel to said channel; and an uncoupling device including a lever arm pivotally connected to said coupler frame adjacent a first end, a plunger adjacent a second end, and an uncoupler armature extending downwardly from said lever arm, wherein said plunger passes through said channel.

13. A coupler arm assembly as recited in claim 12, wherein said uncoupler armature includes an iron-bearing outer surface adapted to react to the application of magnetic force to pivot said lever arm pivotally downwardly.

14. A coupler arm assembly as recited in claim 13, wherein said lever arm, said plunger, and a portion of said uncoupling armature are all formed from a non-iron bearing material.

15. A coupler arm assembly as recited in claim 12, said coupler frame including a trough, said channel formed in a base of said trough, a moving block slidable within said trough, a first end of said moving block connected to said second end of said core pin and a bore extending through said moving block adjacent a second end, said plunger received in said bore.

16. A coupler arm assembly as recited in claim 15, wherein said plunger is angled outwardly away from said lever arm at a given angle with respect to said longitudinal axis, said bore being angled at substantially said given angle.

17. A coupler arm assembly comprising:

a coupler frame extending along a longitudinal axis with a coupler head and a channel, a hollow housing defined between said coupler head and said channel;

a knuckle pivotally connected to said coupler head and movable between a coupled position and an uncoupled position;

a core pin received in said hollow housing, a first end of said core pin selectively engaging said knuckle and a second end of said core pin extending away from said hollow housing and parallel to said channel;

a first distinct uncoupling device including a solenoid disposed about an outer periphery of said coupler frame, said solenoid applying a magnetic force upon activation to move said core pin from engagement with said knuckle; and a second distinct uncoupling device including a lever arm pivotally connected to said coupler frame adjacent a first end, a plunger adjacent a second end, and an uncoupler armature extending downwardly from said lever arm, wherein said plunger passes through said channel.

18. A coupler arm assembly as recited in claim 17, wherein said uncoupler armature includes an iron-bearing outer surface adapted to react to the application of magnetic force to pivot said lever arm pivotally downwardly.

19. A coupler arm assembly as recited in claim 17, said coupler frame including a trough, said channel formed in a base of said trough, a moving block slidable within said trough, a first end of said moving block connected to said second end of said core pin and a bore extending through said moving block adjacent a second end, said plunger received in said bore, wherein said plunger is angled outwardly away from said lever arm at a given angle with respect to said longitudinal axis, said bore being angled at substantially said given angle.

20. A coupler arm assembly as recited in claim 17, wherein said core pin includes a rear section having a first diameter, and a front section having a second diameter greater than said first diameter, said hollow housing including an end wall, said rear section of said core pin passing through an aperture formed in said end wall, and a compression spring disposed about an outer periphery of said rear section of said core pin, a first end of said compression spring engaging said front section and a second end engaging said end wall of said hollow housing, said compression spring biasing said core pin into engagement with said knuckle.

* * * * *